US010865648B2

(12) United States Patent
Yagi et al.

(10) Patent No.: US 10,865,648 B2
(45) Date of Patent: Dec. 15, 2020

(54) TURBINE ROTOR BLADE ASSEMBLY

(71) Applicant: MITSUBISHI HEAVY INDUSTRIES COMPRESSOR CORPORATION, Tokyo (JP)

(72) Inventors: Nobuyori Yagi, Tokyo (JP); Shin Yanagisawa, Tokyo (JP); Yuki Nakamura, Hiroshima (JP); Kyoichi Ikeno, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/345,083

(22) PCT Filed: Dec. 22, 2016

(86) PCT No.: PCT/JP2016/005211
§ 371 (c)(1),
(2) Date: Apr. 25, 2019

(87) PCT Pub. No.: WO2018/116333
PCT Pub. Date: Jun. 28, 2018

(65) Prior Publication Data

US 2019/0249555 A1 Aug. 15, 2019

(51) Int. Cl.
*F01D 5/22* (2006.01)
*F01D 5/30* (2006.01)

(52) U.S. Cl.
CPC ..... *F01D 5/22* (2013.01); *F01D 5/225* (2013.01); *F01D 5/3007* (2013.01); *F05D 2220/31* (2013.01); *F05D 2240/30* (2013.01)

(58) Field of Classification Search
CPC ..... F01D 5/22; F01D 5/225; F01D 5/3007; F05D 2220/31; F05D 2240/30
See application file for complete search history.

(56) References Cited

U.S. PATENT DOCUMENTS 3,185,441 A * 5/1965 Reuter ..... F01D 5/225 416/182

FOREIGN PATENT DOCUMENTS

JP H05-078901 U 10/1993
JP H06-8702 U 2/1994
JP H10-339105 A 12/1998
(Continued)

OTHER PUBLICATIONS

Supplementary European Search Report issued in corresponding European Application No. 16924267.4, dated Oct. 9, 2019 (12 pages).

(Continued)

*Primary Examiner* — Richard A Edgar
(74) *Attorney, Agent, or Firm* — Osha Bergman Watanabe & Burton LLP

(57) ABSTRACT

A turbine rotor blade assembly in which values A, CF, T, and L are set to satisfy the following expression in two-dimensional coordinates, $1.2\times10^5 \leq (A\times CF)/(T\times L) \leq 17\times10^5$, where $(A\times CF)/(T\times L)$ is an expression (1), A is an arm length [mm] of each of turbine rotor blades, CF is centrifugal force [kgf] occurring on each of the turbine rotor blades, T is a thickness [mm] of each of shrouds, and L is a lap amount [mm] of the shrouds adjacent to each other.

13 Claims, 6 Drawing Sheets

(56) References Cited

FOREIGN PATENT DOCUMENTS

| | | | |
|---|---|---|---|
| JP | H11-50804 | A | 2/1999 |
| JP | 2001-200703 | A | 7/2001 |
| JP | 2002-349204 | A | 12/2002 |
| WO | 2005-026501 | A1 | 3/2005 |

OTHER PUBLICATIONS

Yasutomo Kaneko et al.: "Analysis of Vibratory Stress of Integral Shroud Blade for Mechanical Drive Steam Turbine", Aug. 13, 2007; pp. 69-78; XP055612146; Retrieved from the Internet: URL: https://pdfs.semanticscholar.org/aae0/368c3ec9692e47fa49960380c14e55acaeee.pdf (10 pages).

Kyoichi Ikeno et al.: "Application of Integral Shrouded Blade to High Speed and Loading Mechanical Drive Steam Turbine", Jun. 30, 2004; pp. 1-6; XP055612194; Retrieved from the Internet: URL: https://www.mhi.co.jp/technology/review/pdf/e413/e413154.pdf (6 pages).

International Preliminary Report on Patentability in corresponding International Application No. PCT/JP2016/005211, dated Jul. 4, 2019 (6 pages).

* cited by examiner

CONTACT FORCE RATIO $\alpha/\beta$ 0.4~2.5 $T \leqq 8.3\times10^{-6}\times(A\times CF)/L$ AND $T \geqq 0.6\times10^{-6}\times(A\times CF)/L$ CONTACT FORCE RATIO $\alpha/\beta$ 0.7~1.4 $T \leqq 4.3\times10^{-6}\times(A\times CF)/L$ AND $T \geqq 0.9\times10^{-6}\times(A\times CF)/L$ CONTACT FORCE RATIO $\alpha/\beta$ 0.9~1.1 $T \leqq 3.3\times10^{-6}\times(A\times CF)/L$ AND $T \geqq 2.0\times10^{-6}\times(A\times CF)/L$

TURBINE ROTOR BLADE ASSEMBLY

TECHNICAL FIELD

The present invention relates to a turbine rotor blade assembly.

BACKGROUND ART

A steam turbine that converts heat energy generated by, for example, thermal power into mechanical energy through working gas has been operated. The steam turbine includes a stator blade and a rotor blade inside a chamber. As the rotor blade, a plurality of ISBs (Integral Shroud Blades) provided on an outer periphery of a rotor disc are coupled to one another (e.g., Patent Literature 1 and Patent Literature 2). The rotor blade configured by the ISBs (hereinafter, ISB rotor blade) contributes to improvement of vibration-resistance strength of the rotor blade through the coupling of the blades.

The ISB rotor blade includes platforms, blade roots that extend from the respective platforms to an inside of the rotor disc in a radial direction and are fixed to the rotor disc by implantation, profiles that extend outward in the radial direction from the respective platforms, and shrouds provided at respective front ends of the profiles.

The ISB rotor blade achieves the coupling with use of centrifugal force loaded during operation of the steam turbine. In other words, the rotor blades are inclined in a predetermined direction during assembly, whereas the rotor blades rise by the centrifugal force loaded during the operation, and the shrouds are simulatively configured as an integrated structure with use of contact reactive force that is generated by strong contact of the shrouds adjacent to each other. In the ISB rotor blade, a pitch in a circumferential direction of each of the shrouds in an inclined state can be set larger than that in a rising state. Accordingly, in a case where an increased amount of the pitch obtained geometrically is larger than a separation amount of contact surfaces of the shrouds adjacent to each other of the ISB rotor blade due to the centrifugal force and heat during rotation, the contact surfaces are not separated from each other and maintain the coupled state during the rotation.

CITATION LIST

Patent Literature

Patent Literature 1: JP 2001-200703 A
Patent Literature 2: JP 2002-349204 A

SUMMARY OF INVENTION

Technical Problem

The above-described rising function of the turbine rotor blades is based on the premise that the centrifugal force sufficient to cause rising acts on the turbine rotor blades. The centrifugal force acting on the turbine rotor blades is proportional to angular velocity ω (or square of angular velocity ω) of the turbine rotor blades. If the number of rotations (or rotation speed) of the turbine rotor blades is low, the turbine rotor blades cannot rise to a degree achieving the coupling.

Accordingly, an object of the present invention is to provide a turbine rotor blade assembly in which the turbine rotor blades easily rise even at low-speed rotation.

Solution to Problem

The present invention relates to a turbine rotor blade assembly in which a plurality of turbine rotor blades are provided in a circumferential direction of a turbine disc, and the plurality of turbine rotor blades are inclined in a predetermined direction during assembly whereas the plurality of turbine rotor blades rise during rotation operation.

Each of the turbine rotor blades according to the present invention includes a platform including a blade root implanted in a blade groove provided on an outer peripheral surface of the turbine disc, a profile rising from the platform, and a shroud provided at a front end of the profile.

In each of the turbine rotor blades according to the present invention, values A, CF, T, and L are set to satisfy the following expression in two-dimensional coordinates illustrated in accompanying FIG. 5, $$1.2\times10^5\leq(A\times CF)/(T\times L)\leq17\times10^5,$$

where A is an arm length [mm] of each of the turbine rotor blades, CF is centrifugal force [kgf] occurring on each of the turbine rotor blades, T is a thickness [mm] of each of the shrouds, and L is a lap amount [mm] of the shrouds adjacent to each other.

In the turbine rotor blade assembly according to the present invention, the values A, CF, T, and L are preferably set to satisfy the following expression in two-dimensional coordinates illustrated in accompanying FIG. 6, $$T\leq8.3\times10^{-6}\times(A\times CF/L) \text{ and } T\leq0.6\times10^{-6}\times(A\times CF/L).$$

The present invention is effective to the turbine rotor blade assembly performing low-speed rotation in which the turbine rotor blades are operated at the number of rotations of 4000 rpm to 8000 rpm.

Further, the present invention is effective to the turbine rotor blade assembly in which the profile of each of the turbine rotor blades has a height of 20 mm to 80 mm, that is short in blade length.

This is because both turbine rotor blade assemblies are classified into a kind in which the turbine rotor blades are difficult to rise.

In the present invention, a gravity center of each of the profiles is preferably offset from a center of the corresponding blade root to rear side or front side to which the turbine rotor blades are inclined during the assembly.

In the turbine rotor blade assembly according to the present invention, the values A, CF, T, and L are preferably set to satisfy the following expression in the two-dimensional coordinates illustrated in FIG. 5, $$2.3\times10^5\leq(A\times CF)/(T\times L)\leq10.6\times10^5.$$

Further, the values A, CF, T, and L are more preferably set to satisfy the following expression, $$3.0\times10^5\leq(A\times CF)/(T\times L)\leq5.0\times10^5.$$

In the turbine rotor blade assembly according to the present invention, the values A, CF, T, and L are preferably set to satisfy the following expression in the two-dimensional coordinates illustrated in FIG. 6, $$T\leq4.3\times10^{-6}\times(A\times CF/L) \text{ and } T\geq0.9\times10^{-6}\times(A\times CF/L).$$

Further, the values A, CF, T, and L are more preferably set to satisfy the following expression, $$T\leq3.3\times10^{-6}\times(A\times CF/L) \text{ and } T\geq2.0\times10^{-6}\times(A\times CF/L).$$

Advantageous Effects of Invention

According to the present invention, the values A, CF, T, and L are set to satisfy the following expression in the two-dimensional coordinates illustrated in FIG. 5, $$1.2\times10^5 \leq (A\times CF)/(T\times L) \leq 17\times10^5,$$

and further, the values A, CF, T, and L are set to satisfy the following expression in the two-dimensional coordinates illustrated in FIG. 6, $$T \leq 8.3\times10^{-6}\times(A\times CF/L) \text{ and } T \geq 0.6\times10^{-6}\times(A\times CF/L),$$

where, in (A×CF)/(T×L), A is the arm length [mm] of each of the turbine rotor blades, CF is the centrifugal force [kgf] occurring on each of the turbine rotor blades, T is the thickness [mm] of each of the shrouds, and L is the lap amount [mm] of the shrouds adjacent to each other. This makes it possible to provide the turbine rotor blade assembly in which the turbine rotor blades can rise even at the low-speed rotation.

DESCRIPTION OF EMBODIMENTS

An embodiment of the present invention is described below with reference to accompanying drawings.

Figure 1:
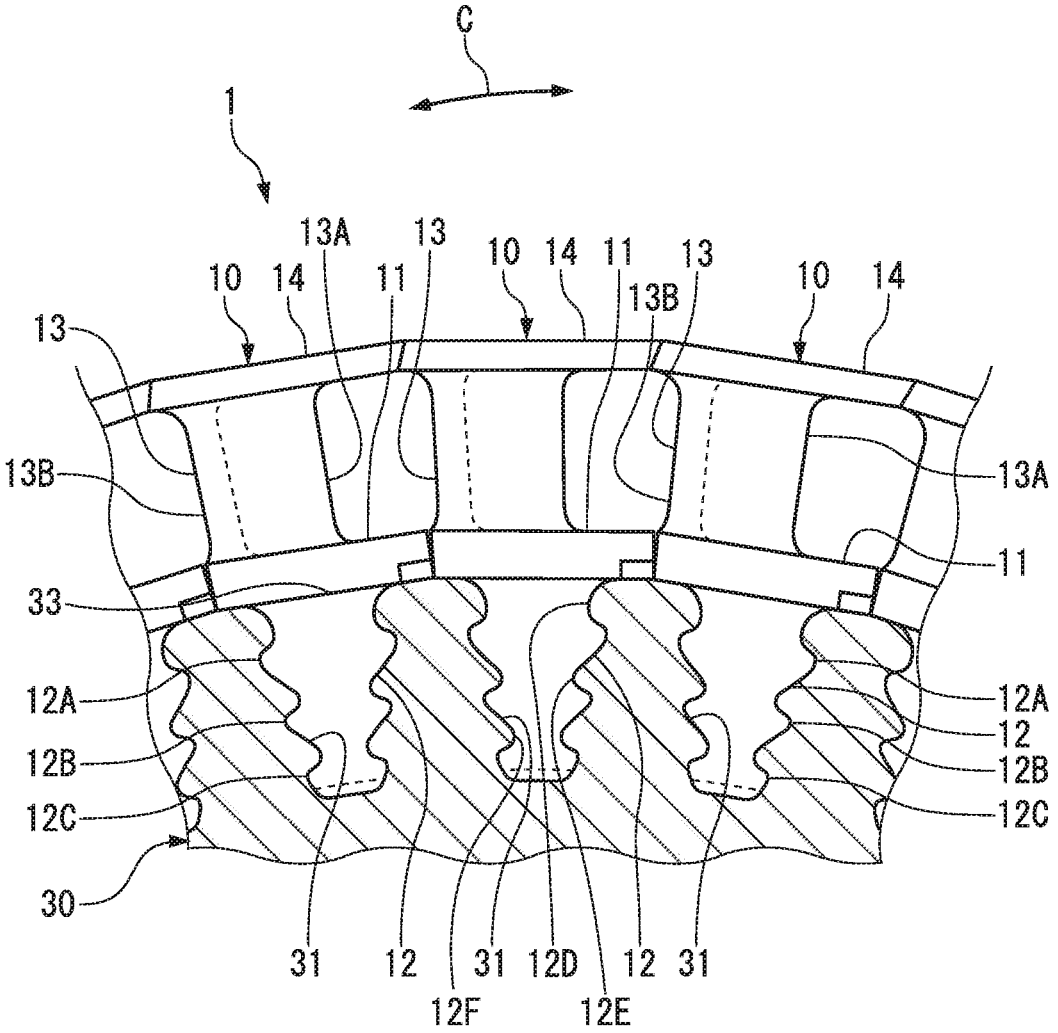
FIG. 1 is a partial cross-sectional view illustrating a turbine rotor blade assembly according to an embodiment of the present invention.

As illustrated in FIG. 1, a turbine rotor blade assembly 1 according to the present embodiment includes a turbine disc 30 including a plurality of blade grooves 31 that are dug down from an outer peripheral surface 33, and a plurality of turbine rotor blades 10 that are held by the turbine disc 30 through the respective blade grooves 31. The turbine rotor blade assembly 1 is used for a steam turbine that converts heat energy generated by, for example, thermal power into mechanical energy. Although FIG. 1 illustrates only a part of the turbine rotor blade assembly 1, the turbine disc 30 has a disc shape, and the plurality of turbine rotor blades 10 are provided over the entire region of the turbine disc 30 in a circumferential direction C.

Each of the turbine rotor blades 10 includes a platform 11, a profile 13, and a shroud 14. The platform 11 includes a blade root 12 that is implanted in the corresponding blade groove 31 of the turbine disc 30, thereby being fixed to the turbine disc 30. The profile 13 rises from the platform 11 on side opposite to the side provided with the blade root 12. The shroud 14 is provided at a front end of the profile 13. In each of the turbine rotor blades 10, the platform 11, the blade root 12, the profile 13, and the shroud 14 may be integrally formed, or for example, the shroud 14 separately fabricated may be joined to the platform 11, the blade root 12, and the profile 13 that are integrally formed.

[Platform 11]

Each of the platforms 11 is a member having a substantially rectangular outer shape in a planar view. The blade roots 12 extend from rear surfaces of the respective platforms 11 toward a center in a radial direction while the turbine rotor blades 10 are assembled to the turbine disc 30. Each of the blade roots 12 according to the present embodiment includes teeth 12A, 12B, and 12C in three stages from a root communicating with the corresponding platform 11 toward a front end. The first tooth 12A, the second tooth 12B, and the third tooth 12C protrude toward both sides in the circumferential direction C of the turbine disc 30. Further, a first tooth groove 12D that is recessed from the platform 11 and the first tooth 12A is provided therebetween, a second tooth groove 12E that is recessed from the first tooth 12A and the second tooth 12B is provided therebetween, and a third tooth groove 12F that is recessed from the second tooth 12B and the third tooth 12C is provided therebetween. Each of the blade grooves 31 of the turbine disc 30 is formed in a shape engaging with the first tooth 12A, the second tooth 12B, and the third tooth 12C as well as the first tooth groove 12D, the second tooth groove 12E, and the third tooth groove 12F.

Figure 3A:
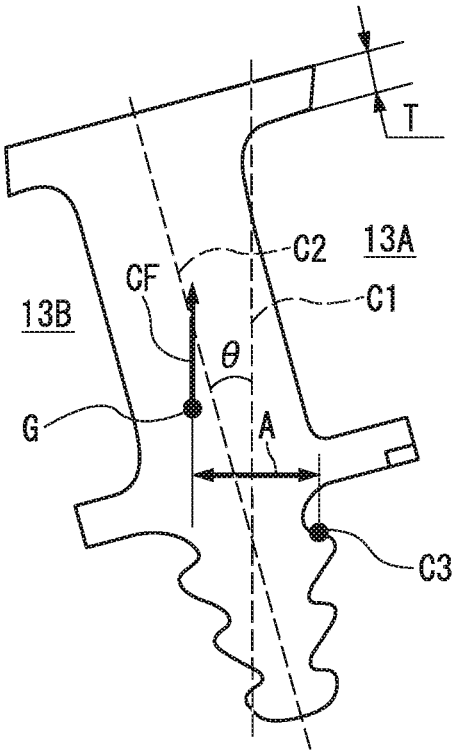
FIGS. 3A and 3B are diagrams each illustrating the single turbine rotor blade according to the present embodiment.

As illustrated in FIG. 3A, in each of the platforms 11, a dimension from a center line C2 of the blade root 12 to an end part on a front side 13A and a dimension from the center line C2 to a rear side 13B are different from each other, and each of the platforms 11 is formed asymmetrically in the circumferential direction with the center line C2 as a center.

Figure 2A:
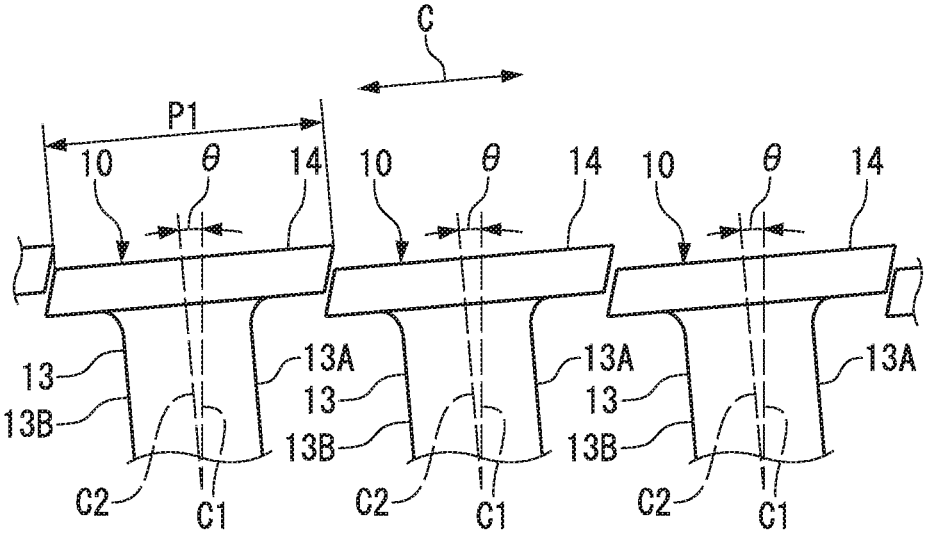
FIGS. 2A and 2B each illustrate turbine rotor blades according to the present embodiment, FIG. 2A illustrating the turbine rotor blades during assembly, and FIG. 2B illustrating the turbine rotor blades during operation.

When the blade roots 12 of the turbine rotor blades 10 are implanted in the respective blade grooves 31 of the turbine disc 30, the turbine rotor blades 10 are inclined by an inclination angle θ as illustrated in FIG. 2A. The inclination angle θ is an angle formed by the center line C2 of each of the blade roots 12 to the center line C1 of the corresponding blade groove 31. As illustrated in FIG. 2A, the center line C1 and the center line C2 are defined by the dimension in the radial direction of the turbine disc 30 for each of the blade grooves 31 and each of the blade roots 12, respectively.

[Profile 13]

As illustrated in FIG. 1 and FIG. 2A, each of the profiles 13 includes the front side 13A and the rear side 13B opposite to the front side 13A, and the front side 13A has a cross-sectional shape recessed toward the rear side 13B. The turbine rotor blades 10 receive steam by the respective recessed front sides 13A to obtain rotational driving force of the turbine disc 30.

[Shroud 14]

As illustrated in FIG. 1 and FIG. 2A, each of the shrouds 14 is a member having a substantially rectangular shape in a planar view. The shrouds 14 are provided so as to face the respective platforms 11 with the respective profiles 13 in between. The shrouds 14 are simulatively configured as an integrated structure with use of contact reactive force F that is generated by strong contact of the shrouds 14 adjacent to each other during operation. When the blade roots 12 are implanted in the respective blade grooves 31 of the turbine disc 30, the platforms 11 of the turbine rotor blades 10 are arranged in the circumferential direction along an outer edge of the turbine disc 30, and the profiles 13 are radially arranged in the radial direction of the turbine disc 30.

[Operation of Turbine Rotor Blade 10]

When the turbine rotor blade assembly 1 is assembled, the turbine rotor blade 10 is inclined by the predetermined inclination angle θ as illustrated in FIG. 2A. The inclination angle θ according to the present embodiment is defined by the angle that is formed by the center line C2 of each of the blade roots 12 to the center line C1 of the corresponding blade groove 31.

Figure 2B:
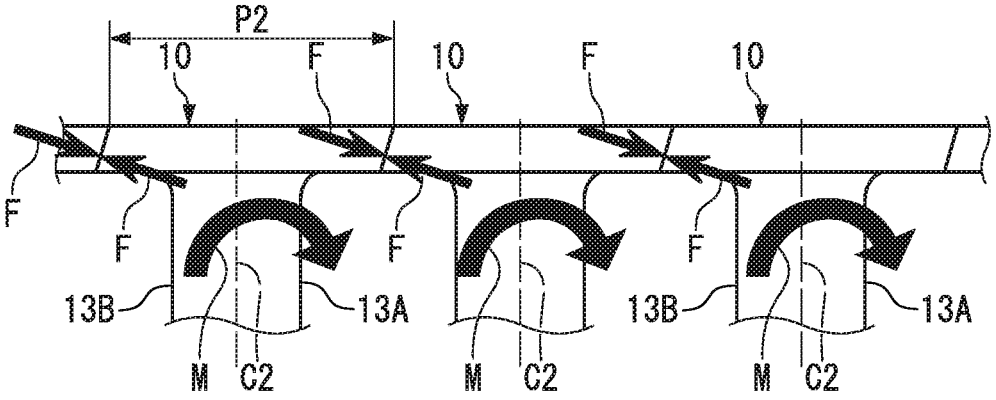

When the turbine rotor blade assembly 1 rotates, rotational moment M occurs from the rear sides 13B toward the front sides 13A of the turbine rotor blades 10 because of a centrifugal force generated on the turbine rotor blade assembly 1. As a result, the turbine rotor blade assembly 1 shifts from the inclined state to a rising state illustrated in FIG. 2B. Note that, in order to clearly illustrate inclination of the turbine rotor blades 10, the inclination is exaggerated in FIGS. 2A and 2B. In addition, in the following, the moment M is also referred to as rising moment M.

In the turbine rotor blades 10, a pitch P1 (FIG. 2A) of each of the shrouds 14 in the circumferential direction C is set larger than a pitch P2 (FIG. 2B) of each of the shrouds 14 in the rising state during the operation. As a result, when the turbine rotor blades 10 rise, the shrouds 14 are simulatively configured as an integrated structure with use of the contact reactive force F that is generated by strong contact of the shrouds 14 adjacent to each other, which makes it possible to maintain a coupled state of the rotating turbine rotor blades 10. Here, a difference between the pitch P1 and the pitch P2 corresponds to a lap amount L of the shrouds 14 adjacent to each other. In other words, the lap amount L=P1−P2. Note that the pitch P1 can be actually measured but the pitch P2 is a designed value.

The rising function of the turbine rotor blades 10 during the operation is based on the premise that centrifugal force necessary for rising of the turbine rotor blades 10 acts on the turbine rotor blades 10. Centrifugal force CF acting on the turbine rotor blades 10 is increased or decreased from a general formula of the centrifugal force ($F=m\cdot r\cdot\omega^2$), depending on the number of rotations (or rotation speed) of the turbine rotor blades 10. Accordingly, when the number of rotations of the turbine rotor blades 10 is low, the turbine rotor blades 10 cannot rise to a degree enough to coupling in some cases even in the same turbine rotor blades 10. Therefore, in the present embodiment, a new condition of the turbine rotor blades 10 that has not existed before and enables the turbine rotor blades 10 to easily rise even at the low-speed rotation is set.

Figure 3B:
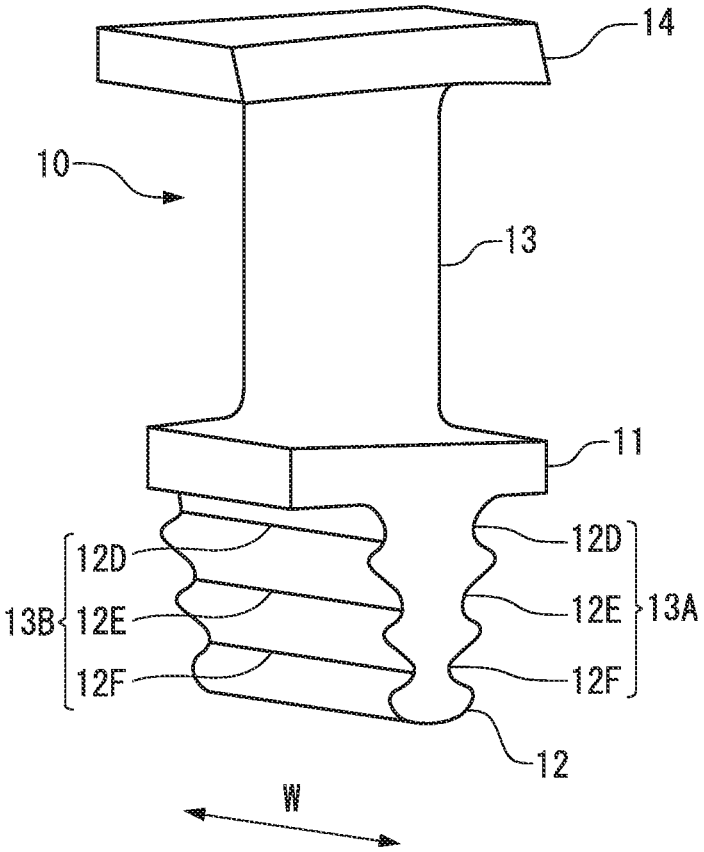

To enable the turbine rotor blades 10 to easily rise even at the low-speed rotation, the following two elements are considered in the present embodiment, with reference to FIG. 2A and FIG. 3B.

(1) Thickness T of Shroud 14

When the turbine rotor blades 10 rise, the shrouds 14 of the turbine rotor blades 10 adjacent to each other come into contact with each other. The contact is a requirement necessary for coupling of the blades; however, the contact inhibits the turbine rotor blades 10 from rising to a degree necessary for the coupling. If the shrouds 14 are easily elastically deformable when the shrouds 14 are in contact with each other, the turbine rotor blades 10 can easily rise. Accordingly, to reduce rigidity of each of the shrouds 14, it is necessary to keep in mind reduction of a thickness T of each of the shrouds 14.

(2) Rising Moment M of Turbine Rotor Blades 10

When the turbine rotor blades 10 receive the centrifugal force CF, the turbine rotor blades 10 attempt to rise because the moment M acts. Therefore, if the rising moment M is increased, the turbine rotor blades 10 easily rise even at the low-speed rotation.

If the rising of the turbine rotor blades 10 is insufficient, partial contact occurs on the blade roots 12 of the turbine rotor blades 10. The partial contact is a phenomenon in which one of the front side 13A and the rear side 13B of each of the blade roots 12 implanted in the blade grooves 31 comes into strong contact with a wall surface of the corresponding blade groove 31 more than the other side during the operation of turbine rotor blade assembly 1. When the turbine rotor blade assembly 1 continues to operate while the partial contact occurs, the tooth grooves 12D to 12F may be cracked.

In accordance with the examination of the present inventors, the partial contact phenomenon can be recognized from balance of the contact force occurring on the front side 13A and the contact force occurring on the rear side 13B of each of the blade roots 12. In other words, the turbine rotor blades 10 easily rise even at the low-speed rotation as a ratio (hereinafter, contact force ratio) of the contact force occurring on the front side 13A and the contact force occurring on the rear side 13B is closer to one. The partial contact phenomenon is described with reference to FIGS. 4A and 4B.

Figure 4A:
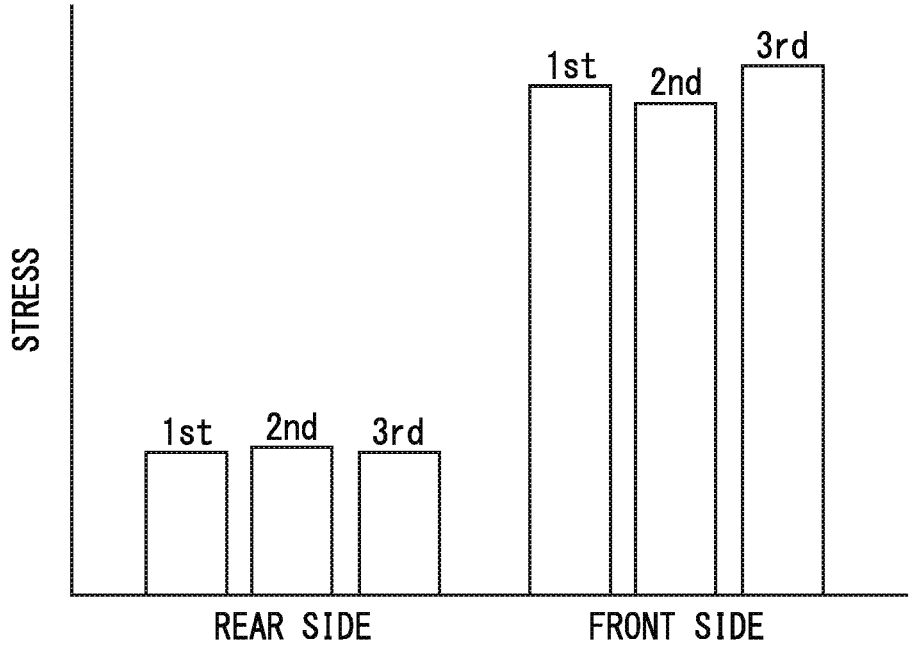
FIGS. 4A and 4B are graphs each comparatively illustrating stress occurring on a rear side and stress occurring on a front side of a blade root of the turbine rotor blade according to the present embodiment, FIG. 4A illustrating an example in which both stresses are unbalanced, and FIG. 4B illustrating an example in which both stresses are balanced.

FIG. 4A illustrates an example of a simulation result of the stress occurring on each of the turbine rotor blades 10 rotating at low speed.

The turbine rotor blades 10 used in the simulation insufficiently rose. The stress determined by the simulation is an average value of main stress occurring in a width direction W of each of the first tooth groove 12D, the second tooth groove 12E, and the third tooth groove 12F of one blade root 12 illustrated in FIG. 3B. The stress is determined for both sides of the front side 13A and the rear side 13B of each of the turbine rotor blades 10. As illustrated in FIG. 4A, the stress occurring on the blade root 12 is largely different between the front side 13A and the rear side 13B.

In FIG. 4A, the stress on the front side 13A is larger than the stress on the rear side 13B. This corresponds to the direction in which the turbine rotor blades 10 are inclined during the assembly of the turbine rotor blades 10. In other words, in the case of the present embodiment, the stress on the front side 13A is large due to inclination of the turbine rotor blades 10 toward the rear side 13B during the assembly. If the turbine rotor blades 10 are inclined toward the front side 13A during the assembly, the stress on the rear side 13B becomes large in contrast to FIG. 4A.

Figure 4B:
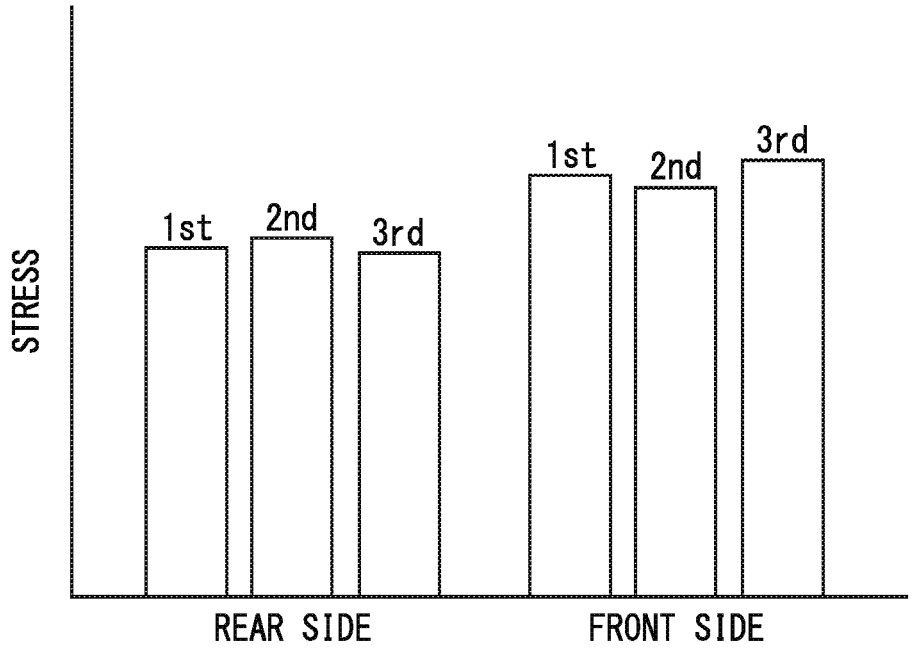

Note that, in FIGS. 4A and 4B, the first tooth groove 12D is abbreviated as 1st, the second tooth groove 12E is abbreviated as 2nd, and the third tooth groove 12F is abbreviated as 3rd.

Therefore, the inventors examined a guideline to bring the contact force ratio closer to one by taking into consideration the thickness T of each of the shrouds 14 and the rising moment M. As a result, the inventors found out that the contact force ratio can be balanced by the following expression (1) while considering the thickness T of each of the shroud 14 and an arm length A. Note that parts A, CF, and T of each of the turbine rotor blades 10 in the expression (1) are as illustrated in FIG. 3A, $$(A\times CF)/(T\times L) \quad (1)$$

where A is the arm length [mm] of each of the turbine rotor blades 10, CF is the centrifugal force [kgf] acting on each of the turbine rotor blades 10, T is the thickness [mm] of each of the shrouds 14, and L is the lap amount [mm] of the shrouds adjacent to each other.

The expression (1) is described below.

A term A×CF that is a numerator is first described.

In the expression (1), the arm length A is a distance from a rotation center C3 to a gravity center G of each of the turbine rotor blades 10, and CF is centrifugal force acting on each of the turbine rotor blades 10. Accordingly, in the expression (1), the term A×CF determines the rising moment M, and is referred to as a moment term in the following. The rotation center C3 of each of the turbine rotor blades 10 is a rotation center when each of the turbine rotor blades 10 receives the centrifugal force CF, thereby rising. The rotation center C3 is determined by design of the turbine rotor blade assembly 1.

Note that the centrifugal force CF can be determined from the following expression (2), $$CF=\{M\cdot R\cdot(2\pi\cdot N/60)^2\}/G \quad (2)$$

where CF is the centrifugal force [kgf] acting on each of the turbine rotor blades 10, M is a mass [kg] of each of the turbine rotor blades 10, R is a rotation radius [m] of each of the turbine rotor blades 10, N is the number of rotations [rpm] of each of the turbine rotor blades 10, and G is gravity acceleration [m/s$^2$].

Next, the term T×L that is a denominator is described.

In the expression (1), T is the thickness of each of the shrouds 14, and L is the lap amount of the shrouds 14 adjacent to each other. Accordingly, in the expression (1), the term T×L determines the contact reactive force F of the shrouds 14 adjacent to each other, and is referred to as a contact force term in the following.

Figure 5:
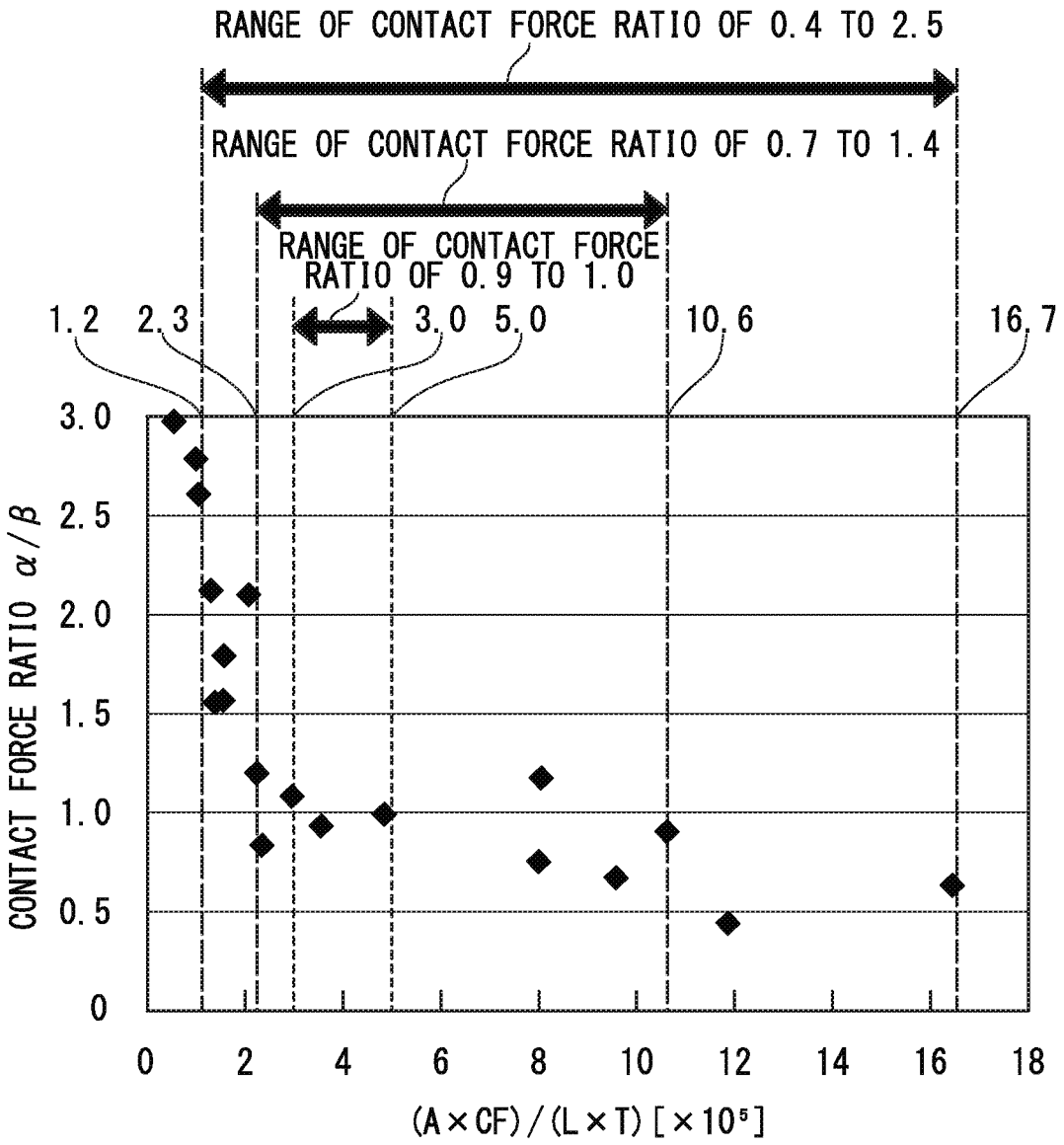
FIG. 5 is a graph illustrating relationship between a calculation result of (A×CF)/(T×L) and a ratio (contact force ratio) of the stress occurring on the rear side and the stress occurring on the front side.

Further, the inventors found out from the examination that a ratio of the contact reactive force F(13A) of the front side 13A to the contact reactive force F(13B) of the rear side 13B of each of the blade roots 12 (hereinafter, contact force ratio α/β) significantly correlates with the result obtained from the expression (1). FIG. 5 illustrates the result.

FIG. 5 is a graph illustrating relationship between the calculation result of the expression (1) and the contact force ratio α/β determined with use of Finite Element Method (FEM), in two-dimensional coordinates including an x coordinate (lateral axis) and a y coordinate (vertical axis). At this time, the FEM is executed while the number of rotations of the turbine rotor blade assembly 1 (turbine rotor blades 10) is optionally set within a range of 4000 rpm to 8000 rpm.

As illustrated in FIG. 5, the contact force ratio α/β tends to increase as the value determined from the expression (1) becomes small. An object of the present embodiment is to reduce the difference between the contact reactive force F(13B) and the contact reactive force F(13A) as much as possible to achieve balance. In the case of the contact force ratio α/β in FIG. 5, the contact reactive force F(13B) and the contact reactive force F(13A) are coincident with each other and is maximally balanced when the contact force ratio α/β is 1.0. In the present embodiment, based on the facts described above, to settle the contact force ratio α/β within the range of 0.4 to 2.5, it is necessary to satisfy the following condition 1-1 in the two-dimensional coordinates in FIG. 5. Further, to settle the contact force ratio α/β within the range of 0.7 to 1.4, it is necessary to satisfy the following condition 1-2. Moreover, to settle the contact force ratio α/β within the range of 0.9 to 1.1, it is necessary to satisfy the following condition 1-3.

$$1.2\times10^5\leq(A\times CF)/(T\times L)\leq17\times10^5 \quad \text{Condition 1-1}$$

$$2.3\times10^5\leq(A\times CF)/(T\times L)\leq10.6\times10^5 \quad \text{Condition 1-2}$$

$$3.0\times10^5\leq(A\times CF)/(T\times L)\leq5.0\times10^5 \quad \text{Condition 1-3}$$

When the arm length A, the centrifugal force CF, the shroud thickness T, and the lap amount L satisfy any of the above-described conditions, it is possible to reduce the difference of the stress occurring on each of the blade roots 12 between the front side 13A and the rear side 13B as illustrated in FIG. 4B.

Here, as illustrated in FIG. 5, the contact force ratio α/β is balanced in some cases even when the calculation result ((A×CF)/(T×L)) of the expression (1) is lower than 1; however, in order to surely balance the contact force ratio α/β irrespective of the number of rotations, the value of the x coordinate in the region according to the present invention illustrated in the two-dimensional coordinates is set to 1.2 or more. An upper limit of the x coordinate is set to 17 for the similar reason.

Figure 6:
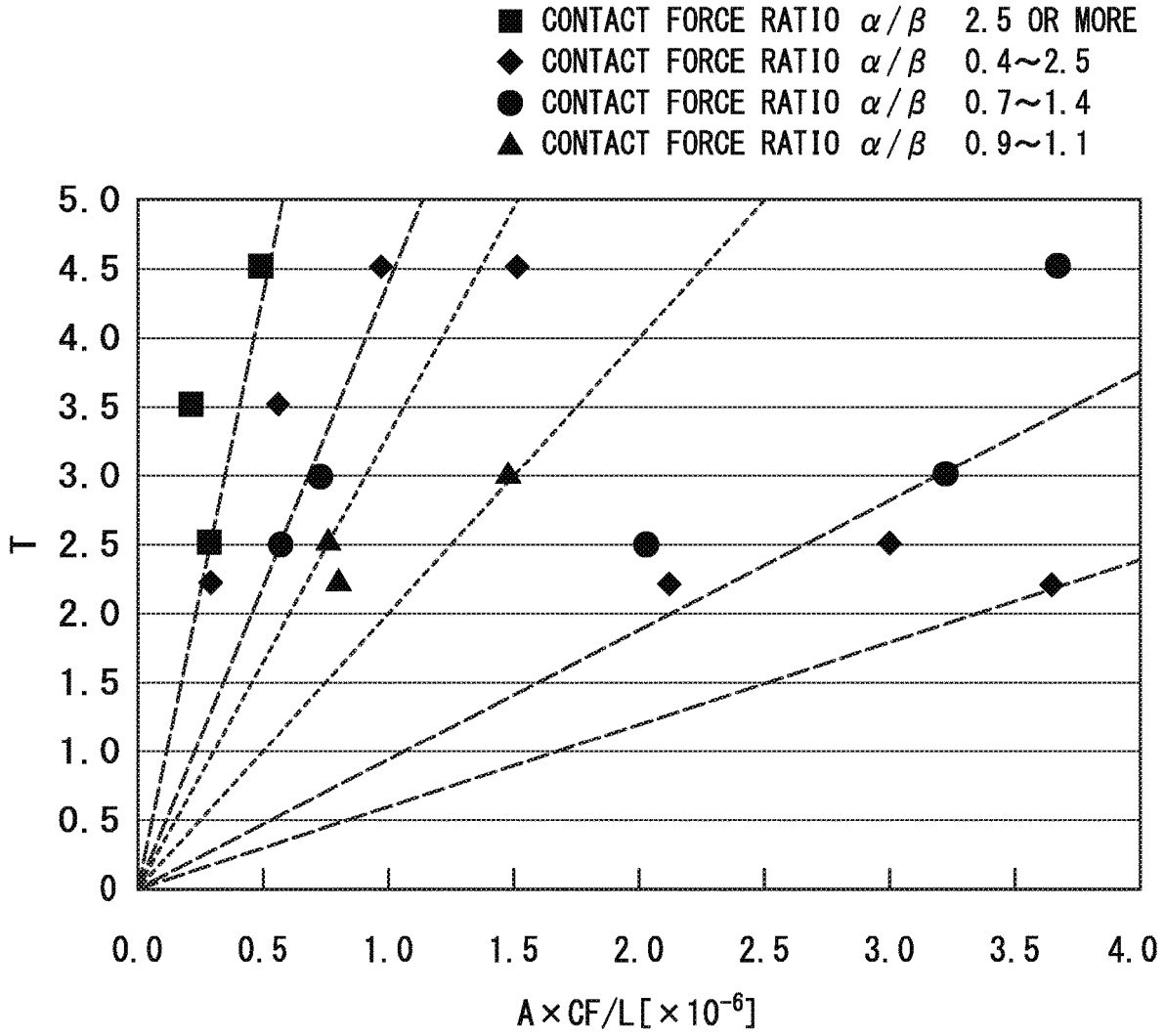
FIG. 6 is a graph illustrating relationship of A×CF/L, a thickness T of each of shrouds, and the contact force ratio.

Next, the present inventors found out that, in order to settle the contact force ratio α/β within the range of 0.4 to 2.5, it is sufficient to determine relationship of the shroud thickness T, the arm length A, the centrifugal force CF acting on each of the turbine rotor blades 10, and the lap amount L. FIG. 6 illustrates the result.

FIG. 6 is a graph in which the values of the contact force ratio α/β determined by the FEM as with FIG. 5 are plotted in the two-dimensional coordinates in association with A×CF/L (x coordinate (lateral axis)) and the shroud thickness T (y coordinate (vertical axis)). At this time, the number of rotations of the turbine rotor blade assembly 1 (turbine rotor blades 10) is optionally set within the range of 4000 rpm to 8000 rpm, as with the FEM in FIG. 5.

As illustrated in FIG. 6, when a condition 2-1 is satisfied, the contact force ratio is within the range of 0.4 to 2.5. In addition, when a condition 2-2 is satisfied, the contact force ratio is within the range of 0.7 to 1.4. Further, when a condition 2-3 is satisfied, the contact force ratio is within the range of 0.9 to 1.1.

$$T\leq8.3\times10^{-6}\times(A\times CF/L) \text{ and } T\geq0.6\times10^{-6}\times(A\times CF/L) \quad \text{Condition 2-1}$$

$$T\leq4.3\times10^{-6}\times(A\times CF/L) \text{ and } T\geq0.9\times10^{-6}\times(A\times CF/L) \quad \text{Condition 2-2}$$

$$T\leq3.3\times10^{-6}\times(A\times CF/L) \text{ and } T\geq2.0\times10^{-6}\times(A\times CF/L) \quad \text{Condition 2-3}$$

The present embodiment is particularly suitable to the turbine rotor blades 10 each having a short blade length. As obvious from the expression (2), the centrifugal force CF becomes large as the blade length of each of the turbine rotor blades 10 is larger, and in contrast, the centrifugal force CF becomes small as the blade length of each of the turbine rotor blades 10 is smaller. Therefore, when the blade length is small, the turbine rotor blades 10 is difficult to rise during the operation. More specifically, the present embodiment is preferably applied to the turbine rotor blades 10 in which the profiles each have the short height of 20 mm to 80 mm, and further, is preferably applied to the turbine rotor blades 10 in which the profiles each have the short height of 30 mm to 60 mm.

As illustrated in FIGS. 3A and 3B, in the turbine rotor blade assembly 1 according to the present embodiment, the gravity center G of each of the profiles 13 is deviated toward the rear side 13B from the center line C2 of the corresponding blade root 12, namely, is offset, which makes it possible to increase the rising moment M.

Note that, in the case of the present embodiment, the gravity center G of each of the profiles 13 is offset toward the rear side 13B because the turbine rotor blades 10 are assembled while being inclined toward the rear side 13B; however, the gravity center G of each of the profiles 13 is offset toward the front side 13A in order to assemble the turbine rotor blades 10 while the turbine rotor blades 10 are inclined toward the front side 13A. In other words, in the present invention, it is sufficient to offset the gravity center G of each of the profiles 13 from the center line C2 of the corresponding blade root 12 to the rear side 13B or the front side 13A to which the turbine rotor blades 10 are inclined during the assembly.

Although the preferred embodiment of the present invention has been described above, the configurations described in the above-described embodiment may be selected or appropriately modified without departing from the scope of the present invention.

For example, the shapes of the platforms 11, the blade roots 12, the profiles 13, and the shrouds 14 are mere examples. For example, each of the blade roots 12 according to the present embodiment includes three teeth, namely, the first tooth 12A, the second tooth 12B, and the third tooth 12C; however, the present invention is applicable to the turbine rotor blades including blade roots that each include two or less teeth or four or more teeth. Further, for example, the planar shape of each of the shrouds 14 is not limited to a simple rectangular shape, and each of the shrouds 14 may include a portion protruded or recessed in a planar direction.

REFERENCE SIGNS LIST

1 Turbine Rotor Blade Assembly
10 Turbine rotor blade
11 Platform
12 Blade root
12A First tooth
12B Second tooth
12C Third tooth
12D First tooth groove
12E Second tooth groove
12F Third tooth groove
13 Profile
13A Front side
13B Rear side
14 Shroud
30 Turbine disc
31 Blade groove
33 Outer peripheral surface

The invention claimed is:

1. A turbine rotor blade assembly in which a plurality of turbine rotor blades are provided in a circumferential direction of a turbine disc, and the plurality of turbine rotor blades are inclined in a predetermined direction during assembly whereas the plurality of turbine rotor blades rise during rotation operation, the turbine rotor blade assembly comprising:

platforms each including a blade root implanted in a blade groove provided on an outer peripheral surface of the turbine disc;

profiles rising from the respective platforms; and shrouds provided at respective front ends of the profiles, wherein values A, CF, T, and L are set to satisfy a following expression in two-dimensional coordinates, $$1.2\times10^5\leq(A\times CF)/(T\times L)\leq17\times10^5,$$

where

A is an arm length [mm] of each of the turbine rotor blades, and CF is centrifugal force [kgf] occurring on each of the turbine rotor blades during a rotation operation of the turbine rotor blade assembly, wherein the arm length is a distance from a rotation center to a gravity center of each of the turbine rotor blades, and the rotation center of each of the turbine rotor blades is a rotation center when each of the turbine rotor blades receives the centrifugal force CF, T is a thickness [mm] of each of the shrouds, and L is a lap amount [mm] of the shrouds adjacent to each other, wherein the lap amount L=P1−P2, where P1 is a pitch of each of the shrouds in the circumferential direction during assembly, and P2 is a pitch of each of the shrouds in the circumferential direction in a rising state of the turbine rotor blade assembly during rotation operation.

2. The turbine rotor blade assembly according to claim 1, wherein the values A, CF, T, and L are set to satisfy a following expression in two-dimensional coordinates, $$T\leq8.3\times10^{-6}\times(A\times CF/L)\text{ and }T\leq0.6\times10^{-6}\times(A\times CF/L).$$

3. The turbine rotor blade assembly according to claim 2, wherein the values A, CF, T, and L are set to satisfy a following expression, $$T\leq4.3\times10^{-6}\times(A\times CF/L)\text{ and }T\geq0.9\times10^{-6}\times(A\times CF/L).$$

4. The turbine rotor blade assembly according to claim 2, wherein the values A, CF, T, and L are set to satisfy a following expression, $$T\leq3.3\times10^{-6}\times(A\times CF/L)\text{ and }T\geq2.0\times10^{-6}\times(A\times CF/L).$$

5. The turbine rotor blade assembly according to claim 2, wherein the turbine rotor blades are operated at a number of rotations of 4000 rpm to 8000 rpm.

6. The turbine rotor blade assembly according to claim 2, wherein the profile of each of the turbine rotor blades has a height of 20 mm to 80 mm.

7. The turbine rotor blade assembly according to claim 2, wherein a gravity center of each of the profiles is offset from a center of the corresponding blade root to rear side or front side to which the turbine rotor blades are inclined during the assembly.

8. The turbine rotor blade assembly according to claim 1, wherein the turbine rotor blades are operated at a number of rotations of 4000 rpm to 8000 rpm.

9. The turbine rotor blade assembly according to claim 1, wherein the profile of each of the turbine rotor blades has a height of 20 mm to 80 mm.

10. The turbine rotor blade assembly according to claim 1, wherein a gravity center of each of the profiles is offset from a center of the corresponding blade root to rear side or front side to which the turbine rotor blades are inclined during the assembly.

11. The turbine rotor blade assembly according to claim 1, wherein the values A, CF, T, and L are set to satisfy a following expression in the two-dimensional coordinates, $$2.3\times10^5\leq(A\times CF)/(T\times L)\leq10.6\times10^5.$$

12. The turbine rotor blade assembly according to claim 1, wherein the values A, CF, T, and L are set to satisfy a following expression in the two-dimensional coordinates, $$3.0\times10^5\leq(A\times CF)/(T\times L)\leq5.0\times10^5.$$

13. The turbine rotor blade assembly according to claim 1, wherein the centrifugal force CF is determined from a following expression, $$CF=\{M\times R\times(2\pi\times N/60)^2\}/G,$$

where M is a mass [kg] of each of the turbine rotor blades, R is a rotation radius [m] of each of the turbine rotor blades, N is a number of rotations [rpm] of each of the turbine rotor blades, and G is gravity acceleration [$m/s^2$].

* * * * *